US008477038B2

(12) United States Patent
Rousseau et al.

(10) Patent No.: US 8,477,038 B2
(45) Date of Patent: Jul. 2, 2013

(54) METHOD OF PRODUCING A PROOF OF PRESENCE OR OF OPERATION OF AN ENTITY IN AN IDENTIFIED ZONE FOR A DURATION GREATER THAN A GIVEN THRESHOLD, AND MONITORING SYSTEM

(75) Inventors: Fédéric Rousseau, Montigny le Bretonneux (FR); Jean-Philippe Deloison, Paris (FR)

(73) Assignee: Cassidian SAS, Elancourt (FR)

( * ) Notice: Subject to any disclaimer, the term of this patent is extended or adjusted under 35 U.S.C. 154(b) by 294 days.

(21) Appl. No.: 12/809,487

(22) PCT Filed: Dec. 18, 2008

(86) PCT No.: PCT/FR2008/001785

§ 371 (c)(1),
(2), (4) Date: Aug. 10, 2010

(87) PCT Pub. No.: WO2009/106729

PCT Pub. Date: Sep. 3, 2009

(65) Prior Publication Data

US 2010/0309003 A1 Dec. 9, 2010

(30) Foreign Application Priority Data

Dec. 21, 2007 (FR) ..... 07 09066

(51) Int. Cl.
*G08B 23/00* (2006.01)

(52) U.S. Cl.
USPC ..... 340/573.4; 235/379; 340/573.1; 340/576; 340/572.4; 340/10.41; 340/539.11; 379/88.01; 600/310; 713/168

(58) Field of Classification Search
USPC ..... 340/573.1, 10.41, 286.05, 571, 576, 340/517, 539.11, 572.4, 8.1; 713/168; 235/379; 379/88.01; 600/310; 375/130; 726/5
See application file for complete search history.

(56) References Cited

U.S. PATENT DOCUMENTS 4,707,592 A * 11/1987 Ware ..... 235/379
6,041,122 A * 3/2000 Graunke et al. ..... 713/168
6,104,279 A * 8/2000 Maletsky ..... 340/10.41
7,009,497 B2 * 3/2006 Nicoletti et al. ..... 340/286.05

(Continued)

OTHER PUBLICATIONS

Shamir, "How to Share a Secret", Communications of the ACM, vol. 22, No. 11, Nov. 1979, pp. 612-613.

(Continued)

*Primary Examiner* — Daniel Wu
*Assistant Examiner* — Israel Daramola
(74) *Attorney, Agent, or Firm* — Pillsbury Winthrop Shaw Pittman, LLP

(57) ABSTRACT

A method for producing a proof of the presence and/or of the availability of an entity in a site over a period that is greater than or equal to a presence threshold, the method including: successively transmitting messages, the messages being generated from a secret such that the secret may be reconstituted by having the knowledge of a given number of messages that is greater than or equal to a threshold, each message being transmitted over a transmission period whose duration is chosen such that the product of the duration of the transmission period times the threshold is substantially equal to the presence threshold; comparing the secret and a secret candidate generated from messages received by the entity; the proof being produced only if the secret and the secret candidate are equal.

18 Claims, 2 Drawing Sheets

U.S. PATENT DOCUMENTS

Figure 1A:
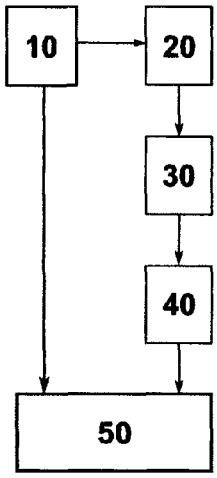

| | | | | |
|---|---|---|---|---|
| 7,898,423 | B2 * | 3/2011 | Cavanaugh | 340/573.1 |
| 8,095,193 | B2 * | 1/2012 | Ridder et al. | 600/310 |
| 2002/0082921 | A1 | 6/2002 | Rankin | 705/14.35 |
| 2003/0091094 | A1 * | 5/2003 | Epstein | 375/130 |
| 2007/0064884 | A1 * | 3/2007 | Corcoran | 379/88.01 |
| 2007/0164865 | A1 * | 7/2007 | Giasson et al. | 340/572.4 |
| 2008/0117053 | A1 * | 5/2008 | Maloney | 340/572.4 |
| 2010/0127850 | A1 * | 5/2010 | Poder | 340/517 |
| 2010/0253504 | A1 * | 10/2010 | Lliteras et al. | 340/539.11 |
| 2011/0068921 | A1 * | 3/2011 | Shafer | 340/571 |
| 2011/0289564 | A1 * | 11/2011 | Archer et al. | 726/5 |
| 2012/0013443 | A1 * | 1/2012 | Poder | 340/8.1 |
| 2012/0105234 | A1 * | 5/2012 | Oguri et al. | 340/576 |

OTHER PUBLICATIONS

International Search Report as issued for PCT/FR2008/001785, dated Aug. 5, 2009.

* cited by examiner

METHOD OF PRODUCING A PROOF OF PRESENCE OR OF OPERATION OF AN ENTITY IN AN IDENTIFIED ZONE FOR A DURATION GREATER THAN A GIVEN THRESHOLD, AND MONITORING SYSTEM

CROSS-REFERENCE TO RELATED APPLICATIONS

This is the U.S. National Stage of PCT/FR2008/001785, filed Dec. 18, 2008, which in turn claims priority to French patent application Ser. No. 07/09066, filed Dec. 21, 2007, the entire contents of all applications are incorporated herein by reference in their entireties.

The invention relates to a method of producing a proof of presence or of operation of an entity in an identified zone for a duration greater than a given threshold, and an electronic monitoring system. In particular, the invention applies to the tracking of persons under conditional freedom or in a probationary situation, or else to the generation of proofs of reliability and of availability of devices.

The production of a formal proof of presence or of operation of an entity, whether it is a person or an object, is necessary in many applications. It is, for example, useful to create such a proof to certify the presence of an employee in his workplace over a duration greater than or equal to the duration stipulated in his work contract. The generation of this type of proof is also necessary with electronic home judicial control systems. The production of a formal proof relative to the time of use of a piece of equipment beyond an accumulated time greater than a contractual threshold, and justifying, for example, the application of a differentiated rate, is still another example, as is the proof of reaching equipment availability objectives.

To establish such proof, implementing access control means at a site to date the entries and exits of the entity to be controlled is known. Using control and recording means to activate elementary events produced by said entity is also known. It is also possible to track the position of the entity at all times. These technical solutions have in common the need to store spatial and temporal information peculiar to the entity. In particular, when the entity is a person, the use of time of the latter is then at least partially stored. In particular, when the entity is a device, operations performed on the latter are then at least partially stored. This information may have a confidential character. Broadcasting this information, voluntarily or following an infraction (compromise by a physical or computer-based attack), is thus potentially prejudicial to the private life or raises problems of confidentiality. In addition, the proof produced by these technical solutions is only reliable if the integrity of the corresponding means is guaranteed, which is not always possible to verify by means of devices whose, cost or flexibility of use are proportional compared with the issues.

One particular object of the invention is to mitigate the aforementioned disadvantages. For this purpose, the object of the invention is a method of producing a proof of presence and/or of the availability of an entity in a site over a period greater than or equal to a presence threshold. The method comprises:

a second step of successive transmissions of messages, said messages being generated from a secret such that the secret may be reconstituted by having the knowledge of a given number of messages that is greater than or equal to a threshold, each message being transmitted over a transmission period whose duration is chosen such that the product of the duration of the transmission period times the threshold is substantially equal to the presence threshold;

a fifth step of comparing the secret and a secret candidate generated from messages received by the entity.

The method produces proof of the presence and/or of the availability of the entity in the site over a period that is greater than or equal to the presence threshold only if the secret and the secret candidate are equal.

The transmission duration of each message may be less than or equal to the duration of the transmission period, each message being transmitted at a random time within the time slot of the transmission period duration, the transmission of said message ending at the latest at the end of the transmission period.

Furthermore, each message may comprise a transmission date and/or sequence number. In particular, this embodiment enables security to be increased, and particularly enables the security of the underlying transmission against playback to be improved. The messages may also be signed, allowing a possible playback of old messages M by a third party that had recorded them to be detected.

In an embodiment of the method according to the invention, the transmission of messages is dependent on the detection of the presence of the entity. In particular, the entity may be identified from an access control list.

In another embodiment of the method according to the invention, the messages are transmitted after connection to the entity.

Still another object of the invention is a monitoring system adapted to the implementation of the method according to the invention. In particular, the system comprises:

at least one tracking device;

at least one piece of equipment detecting the presence and/or availability of the entity;

means for establishing, inside the site between the tracking device and the detecting equipment, a data link conveying messages;

means to generate the secret candidate;

a piece of assessing equipment adapted to compare the secret and the secret candidate.

The monitoring system may also comprise detection or constraint means of the position of the tracking device in the site, in particular allowing the position of the tracking device in the site and therefore ultimately the validity of the proof produced to be guaranteed. The means to establish a data link inside the site between the tracking device and the detecting equipment comply with, for example, IEEE specification 802.15.4.

In an embodiment, the tracking device is a transmitting tracking device adapted to the transmission of messages, the piece of equipment detecting the presence and/or availability of the entity being adapted to receive and store messages.

In another embodiment, the tracking device is a receiving tracking device adapted to receiving and storing messages, the piece of equipment detecting the presence and/or availability of the entity being adapted to transmitting messages.

One of the advantages of the invention is, in particular, that the invention enables the exceeding of a minimum presence rate (respectively an operation rate) to be proven, i.e., to produce proof of attendance (respectively proof of availability) in the zone identified during the monitoring period, and thus is applied for both a continuous presence (respectively an ongoing operation) and to accumulated intermittent presences (respectively irregular operation). Another advantage of the invention is that the history of presence dates and times (respectively operation) during the monitoring period is useless for constructing the proof.

Figure 1B:
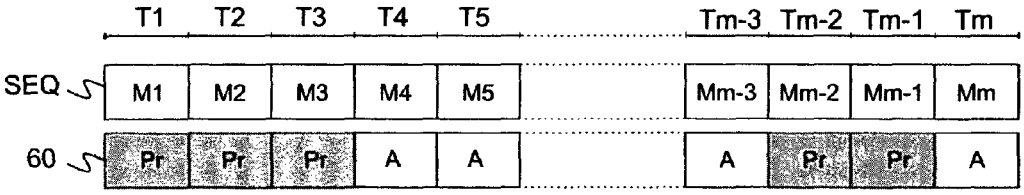
Figure 2:
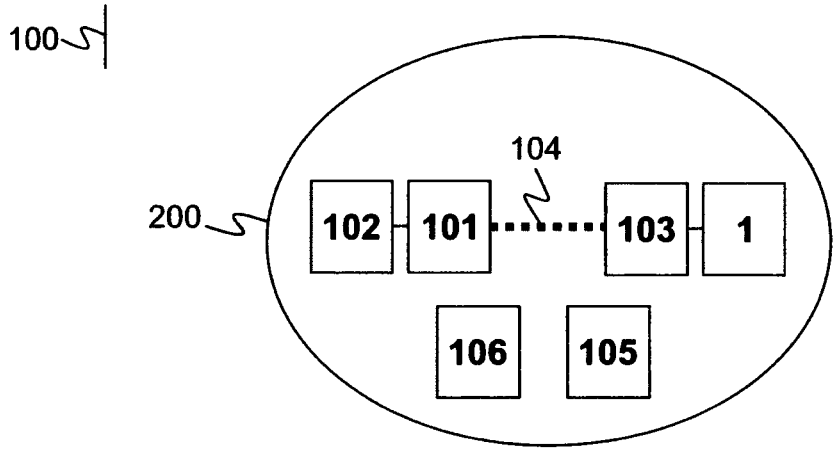

Other characteristics and advantages of the invention will appear more clearly upon reading the following description with regard to the attached drawings that represent:

FIG. 1*a*, a block diagram of the method according to the invention of producing proof of the presence or of operation of an entity in a zone identified during a duration that is greater than a given threshold;

FIG. 1*b*, a time chart of a case of utilization of the method according to the invention of producing proof of the presence or of operation of an entity;

FIG. 2, an electronic monitoring system according to the invention.

FIG. 1*a* illustrates, by a block diagram, the method according to the invention of producing proof of the presence or of operation of an entity in a zone identified during a duration that is greater than a given presence threshold SP.

The method according to the invention comprises a first step 10 of generating a sequence SEQ comprising an integer m of messages M. The sequence SEQ is generated from a secret P such that the secret P may be reconstituted from the knowledge of an integer i of messages M greater than or equal to an integer k called the threshold k. Therefore, if an entity has knowledge of an integer i greater than or equal to the integer k of messages M, said entity will be able to reconstitute the secret P. On the contrary, when this entity will only have knowledge of an integer j strictly less than the integer k, said entity will not be able to reconstitute the secret P. To generate the sequence SEQ, it is possible, for example, to define a polynomial Q of degree k−1 with values in a finite field, wherein the coefficient of degree 0 is equal to the secret P, and wherein the message m of ordinal rank x in sequence SEQ (x being an integer between 1 and m) is equal to the value of the function of the polynomial Q for argument x. Thus, the secret P may be reconstituted by the knowledge of at least k messages M, by utilizing, for example, the Lagrange interpolation to recover polynomial Q and thus ultimately the secret P. Such a method is, for example, disclosed in the article A. Shamir, "How to share a secret," Communications of the ACM, 22-1979, pp. 612-613. In general, any method operating equivalently, generally brought together under the term threshold cryptography diagram, may be suitable for generating the sequence SEQ.

The method according to the invention comprises a second step 20 of transmitting the sequence SEQ. Thus, successively, each message M of the sequence SEQ is transmitted during a transmission period T. Each message is transmitted once during the monitoring period of duration m.T.

In a particular embodiment of the second step 20, the expected duration for transmitting each message M is substantially equal to the transmission period T.

In a particular embodiment of the second step 20, the effective transmission duration of each message M is equal to D, D being less than or equal to the transmission period T; Each message M is transmitted at a random time in the time slot with a duration equivalent to the transmission period T allocated to it, the start of transmission beginning randomly between time 0 and time T-D of the time slot of the allocated transmission period T, such that the transmission of message, M ends at the latest at the end of the time slot of the allocated transmission period T.

In a particular embodiment of the second step 20, said sequence SEQ can only be transmitted within a geographical zone of coverage in predetermined transmission. Typically, the geographical zone of coverage in transmission is defined so as to be substantially identical to the zone in which entity 1 must prove its presence and/or availability.

In a particular embodiment of the second step 20, in particular to increase the level of overall security of the method according to the invention, particularly in the case where the security of the underlying transmission means is insufficient against replay, each message M comprises a transmission date and/or sequence number. The messages M thus constituted may then be signed by using a common cryptographic method for authenticating messages, such as a digital signature. This embodiment presents the advantage of, in particular, detecting the possible playback of old messages M by a third party that had recorded them.

The method according to the invention comprises a third step 30 of receiving and storing one or more messages M from the sequence SEQ. Thus, each message M of the sequence SEQ is potentially successively received during the given transmission period T.

In a particular embodiment of the third step 30, said sequence SEQ can only be received within a geographical zone of coverage in predetermined reception. Typically, the geographical zone of coverage in transmission is defined so as to be substantially identical to the zone in which entity 1 must prove its presence and/or availability.

In all embodiments of the second and third step of the method according to the invention, reception during the third step 30 of messages M transmitted during the second step 20 is only possible when entity 1 is present and/or available in the geographical zone in which entity 1 must prove its presence and/or availability. Thus, if entity 1 is not present and/or available in the geographical zone, the reception of messages M is not possible. As soon as entity 1 is again present and/or available in the geographical zone, the reception of messages M becomes possible again.

In a particular embodiment of the second step 20 and third step 30 of the method according to the invention, a method to secure the data link ensured by the underlying transmission means is used, supporting the transmission and reception, of messages M. By way of example, the securing method may be a transmission method secured by a spectrum spread code or by frequency hops, controlled by a pseudorandom sequence generated by a cryptographic algorithm dependent on a secret key. Such methods are generally designated by the acronym "TRANSEC." It is then difficult or even impossible to intercept the messages M and thus to subsequently replay them. This embodiment thus enables the overall security level of the method according to the invention to be improved by prohibiting a third party from recording and playing back the transmission of messages and a terminal from reconstituting, subsequently and/or outside, the considered zone of monitoring, a false evidence of the presence/availability of entity 1.

During the second step 20 and the third step 30 of the method according to the invention, messages M may be transmitted in unconnected unidirectional mode, i.e., in broadcast mode.

Alternately, during the second step 20 and third step 30 of the method according to the invention, the effective transmission of a message M in unidirectional mode may be dependent on the implementation of a protocol in bidirectional mode of detecting the presence of at least one authorized participant, this protocol being associated with underlying transmission means. The authorized participants may again be identified in an access control list, associated with underlying transmission means.

In another particular embodiment of the second step 20 and third step 30 of the method according to the invention, messages M are transmitted by means of a protocol in bidirectional and connected mode. Thus, messages M are only exchanged after connection and possibly authentication of participants to the communication. It is then possible to verify the presence or even to authenticate the recipient of messages M before they are transmitted. Thus, this embodiment enables, in particular, the overall security level of the method according to the invention to be improved, by prohibiting a third party terminal from receiving messages M necessary to reconstitute proof of the presence/availability of entity 1. This embodiment may, in addition, be combined with the use of the previously described "TRANSEC" type methods.

The method according to the invention comprises a fourth step of generating a secret candidate P' from messages M received at the third step 30 of the method according to the invention. A method reverse from that employed to generate the sequence SEQ from the secret P during the first step 10 of the method according to the invention is then employed. For example, if messages M have been obtained during the first step 10 by calculating the value of the function of polynomial Q for the argument corresponding to said messages M, the secret candidate P' will be reconstituted from the messages M received at the third step 30 by utilizing, for example, the Lagrange interpolation to recover a polynomial Q' and thus ultimately the secret candidate P'. Production of the secret candidate P' may be carried out by the entity receiving the messages M itself.

The method according to the invention comprises a fifth step 50 of comparing the secret P and the secret candidate P'. Two cases emerge.

In a first case, the secret P and the secret candidate P' are equal, or at least equivalent: Proof of the receipt of a number of messages M greater than or equal to the threshold k is then acquired. Each message M being transmitted during the transmission period T, proof of the presence and/or availability of entity 1 over a period that is greater than or equal to a period k*T equal to the presence threshold SP is then acquired. Only the knowledge of the secret P and of the secret candidate P' is necessary for generating proof of the presence and/or availability of entity 1, said secrets P and P' not necessarily comprising personal or confidential information, such as, for example, the presence or availability times of entity 1.

In a second case, secret P and the different secret candidate P' or secret candidate P' cannot be produced: proof of the receipt of a number of messages M greater than or equal to the threshold k is then not produced. This case may in particular be produced if the number of messages M received during the third step 30 is strictly less than the threshold k, due to the fact, for example, of the absence or unavailability of entity 1 in the geographical zone in which entity 1 must prove its presence and/or availability. Another example ending in the impossibility of providing the secret candidate P' is the case where the data link supporting the transmission and receipt of messages M could not be established, particularly because the unauthorized third party wishing to listen to messages M could not be connected to or could not decode the link. Proof of the presence and/or availability of entity 1 over a period that is greater than or equal to a period k*T equal to the presence threshold SP thus is not produced.

FIG. 1*b* illustrates by a time chart a case of utilization of the method according to the invention of producing proof of the presence or of operation of an entity. The sequence SEQ, represented in FIG. 1 *b*, comprises messages M1, M2, M3, M4, M5, Mm-3, Mm-2, Mm-1, Mm respectively transmitted over periods T1, T2, T3, T4, T5, Tm-3, Tm-2, Tm-1, Tm. FIG. 1*b* further comprises a time chart 60 representing periods in the course of which entity 1 is present and/or available in the geographical zone in which entity 1 must prove its presence and/or availability. Thus, entity 1 is, in this example, present and/or available (periods marked by the letters Pr in FIG. 1*b*) during periods T1, T2, T3, Tm-2 and Tm-1 and thus absent during periods T4, Tm (periods marked by the letter A in FIG. 1 *b*). The reception during the third step 30 of messages M transmitted during the second step 20 is only possible when entity 1 is present and/or available in the geographical zone in which entity 1 must prove its-presence and/or availability, in this example during periods T1, T2, T3, Tm-2 and Tm-1. Conversely, the reception of messages M is not possible in this example during periods T4, T5, Tm-3, Tm. In this example, supposing that the data link supporting the transmission and reception of messages M could be established, at least 5 messages M could have been received during the third step 30. If threshold k is set at 3, the secret candidate P' will be generated during the fourth step 40 and the comparison of the secret P and of the secret candidate P' during the fifth step 50 will end in the first case, where the secret P and the secret candidate P' are equal. Thus, proof of the presence and/or availability of entity 1 during a duration greater than or equal to 3 times the duration of period T1 (the duration of each of periods T1 . . . Tm being identical) in the geographical zone in which entity 1 must prove its presence and/or its availability will then be produced.

FIG. 2 shows, by a diagram, an electronic monitoring system 100 according to the invention. The electronic monitoring system 100 particularly enables proof of the presence and/or availability of entity 1 in a site 200 during an accumulated time greater than the presence threshold SP to be established. The electronic monitoring system 100 is particularly adapted to the implementation of the method according to the invention of producing proof of the presence or of operation of an entity in a zone identified during an accumulated time that is greater than a given threshold. The monitoring system according to the invention comprises at least one tracking device 101. The system further comprises detecting or constraint means 102 of the position of the tracking device 101 in site 200. To guarantee an adapted level of overall security of system 100, the tracking device 101 must remain in site 200. Thus the detection or constraint means 102 may be fixation means making displacement of tracking device 101 outside site 200 difficult without deteriorating it and/or without leaving traces of its displacement, such as, for example, a non removable pin. Therefore the detection or constraint means 102 may be means for detecting the displacement outside site 200 of tracking device 101. Similarly, the detection or constraint means 102 may be means for determining the position of the tracking device 101 and of its deactivation if the device does not Correspond to site 200. Thus, in case of displacement of tracking device 101 outside site 200, proof of the presence of the entity cannot be guaranteed. In addition, system 100 comprises at least one piece of equipment 103 detecting the presence and/or availability of entity 1. Entity 1 that wishes to prove its presence and/or availability in site 200 must then have in its possession the detecting equipment 103. In addition, system 100 comprises means for establishing a data link 104 between the tracking device 101 and the detecting equipment 103. The data link 104 can only be established inside site 200. The system further comprises an assessing equipment 105 adapted for implementing the fifth step of the method according to the invention for comparing the secret P and the secret candidate P' and a configuration equipment 106 adapted for implementing the first step of the method according to the invention for generating a sequence SEQ comprising an integer m of messages M. The configuration equipment 106 thus enables, in particular, m messages m to be generated from the secret P. The configuration equipment 106 may be computer-based equipment.

In a first embodiment, tracking device 101 is a transmitting tracking device adapted to implementing the second step of the method according to the invention for transmitting the sequence SEQ and the detecting equipment 103 is a detecting receiving equipment adapted for implementing the third step of the method according to the invention for receiving and storing messages M of sequence SEQ. By way of example, the tracking device 101 may be a transmitting tracking device that complies with IEEE specification 802.15.4, commonly designated under the term ZigBee. The ZigBee type tracking device 101 may, for example, comprise a non removable pin as the constraint means 102, and comprise a battery and a ZigBee microcontroller. The transmitting tracking device 101 is adapted to transmit the sequence SEQ of m messages M in ZigBee frames in compliance with IEEE specification 802.15.4; each fixed length message is transmitted during a period T. However, other types of tracking devices may be employed, in particular, transmitting tracking devices with radiocommunication technology, that comply with, for example, the "Bluetooth" personal networks (IEEE 802.15.1) or the "UWB" (IEEE 802.15.3) standard, with read-write tags without contact standards (for example, with the RF-id ISO 18000 standard), with the WIFI wireless local network standard (IEEE 802.11) or "WIMAX" wireless local loop standard (IEEE 802.16), with "3GPP" cellular mobile radio systems (3GPP TS 23.041 'Cell Broadcast Service'), with the TETRA professional mobile radio communication standard (ETSI EN 300 392), or, in particular, transmitting tracking devices of terrestrial or satellite broadcasting technologies, such as the DVB digital video broadcasting standards (ETSI TS 102 472): the associated site 200 is then determined by the radio coverage ensured by said tracking device; Other types of tracking devices may be employed, in particular satellite tracking devices of a global navigation satellite system (GNSS) such as GPS-III M-Code or GALILEO (ESA-ESNIS GALILEO SIS ICD) when they implement a spot beam, or such as EGNOS (ESA EGNOS SIS ICD) offering a specific regional service, delimiting a geographical zone forming a site 200 equal to the land-based regional footprint of the radio navigation beam, or again in particular wireline networking equipment (e.g. USB, Ethernet, Internet Protocol). The configuration equipment 106 is employed to communicate the m messages M generated during the first step 10 to the transmitting tracking device 101. In a particular embodiment, the configuration equipment 106 is kept in a safe place outside the zone where the tracking device is installed, in order to protect the confidentiality of the secret P by distance. In another particular embodiment, the configuration equipment 106 may be integrated with the transmitting tracking device 101. In a particular embodiment, the configuration equipment 106 and the assessing equipment 105 are included in the same equipment. By way of example, the detector receiver equipment 103 may comprise a receiver in compliance. With IEEE specification 802.15.4. The detector equipment 103 may, for example, be personal assistant type equipment (more generally designated by the acronym "PDA" for "Personal Digital Assistant") or even an electronic bracelet worn by entity 1. However, other types of detector receiver equipment 103 may be employed, particularly radiocommunication technology receivers (e.g. "Bluetooth," "UWB," "RF-ld," "WIFI," "WIMAX," "GSM/3GPP," "TETRA"), or rather terrestrial or satellite broadcasting technology receivers (e.g. "DVB"), or radiolocation or satellite navigation receivers (e.g. "GNSS": "GPS," "EGNOS," "GALILEO") or even wireline network equipment (e.g. USB, Ethernet, Internet Protocol). The detector receiver equipment 103 is particularly adapted to store messages M received via the link 104 of complete data, all different and not necessarily Consecutive. Implementation of the fourth step 40 of the method according to the invention for generating a secret candidate P' from messages M received at the third step 30 of the method according to the invention may be carried out either by the detector receiver equipment 103 that then comprises calculation means for the generation of the secret candidate P' or by the assessing equipment 105 that then comprises means for reading the messages M stored by the detector receiver equipment 103 and calculation means for generating the secret candidate P'.

In a second embodiment, tracking device 101 is a receiving tracking device adapted to implementing the third step of the method according to the invention for receiving and storing messages M of the sequence SEQ and the detecting equipment 103 is a transmitting equipment adapted for implementing the second step of the method according to the invention for transmitting sequence SEQ. By way of example, tracking device 101 may be a receiving tracking device in compliance with IEEE specification 802.15.4. The ZigBee type tracking device 101 may, for example, comprise a non removable pin as the constraint means 102, and comprise a battery and a ZigBee microcontroller. The receiving tracking device 101 is adapted to receive and store messages from the sequence SEQ of m messages M. However, other types of tracking devices may be employed, in particular, receiving tracking devices of radiocommunication technologies (e.g. Bluetooth, UWB, RF-ld, WIFI, WIMAX, GSM/3GPP, TETRA), or rather receivers of terrestrial or satellite broadcasting technologies (e.g. DVB), or even wireline network equipment (e.g. USB, Ethernet, Internet Protocol) . . . . The receiver tracking device 101 is particularly adapted to store messages M received via the link 104 of complete data, all different and not necessarily consecutive. Implementation of the fourth step 40 of the method according to the invention for generating a secret candidate P' from messages M received at the third step 30 of the method according to the invention may be carried out either by the receiver tracking device 101 that then comprises calculation means for the generation of the secret candidate P' or by the assessing equipment 105 that then comprises means for reading the messages M stored by the receiver tracking device 101 and calculation means for generating the secret candidate P'. By way of example, the detector transmitter equipment 103 may comprise a transmitter in compliance with IEEE specification 802.15.4 adapted for transmitting messages M in ZigBee frames in compliance with IEEE specification 802.15.4. The detector transmitter equipment 103 may, for example, be personal assistant type equipment (more generally designated by the acronym "PDA" for "Personal Digital Assistant") or even an electronic bracelet worn by entity 1. However, other types of detector transmitter equipment 103 may be employed, particularly radiocommunication technology receivers (e.g. "Bluetooth," "UWB," "RF-ld," "WIFI," "WIMAX," "GSM/3GPP," "TETRA"), or rather terrestrial or satellite broadcasting technology transmitter tracking devices (e.g. "DVB"), or even wireline networking equipment (e.g., USB, Ethernet, Internet Protocol). The configuration equipment 106 is employed to communicate the m messages M generated during the first step 10 to the detector transmitter equipment 103.

The means to generate the secret candidate P' during the fourth step 40 is an entity adapted to store the messages M received, such as the detector equipment 103 according to the first embodiment or such as the tracking device 101 according to the second embodiment, and/or such as the assessing equipment 105 according to the applicable scenario for generating P'.

The invention claimed is:

1. A method for producing a proof of the presence and/or of the availability of an entity in a site over a period that is greater than or equal to a presence threshold, the method comprising:

successively transmitting messages, said messages being generated from a secret such that the secret may be reconstituted by having the knowledge of a given number of messages that is greater than or equal to a threshold, each message being transmitted over a transmission period whose duration is chosen such that the product of the duration of the transmission period times the threshold is substantially equal to the presence threshold;

comparing the secret and a secret candidate generated from messages received by the entity;

the proof being produced only if the secret and the secret candidate are equal.

2. The method according to claim 1, wherein the transmission duration of each message is less than or equal to the duration of the transmission period, each message being transmitted at a random time within the time slot of the transmission period duration, the transmission of said message ending at the latest at the end of the transmission period.

3. The method according to claim 1, wherein each message comprises a transmission date and/or sequence number.

4. The method according to claim 3, wherein the messages are signed.

5. The method according to claim 1, wherein the transmission of messages is dependent on the detection of the presence of the entity.

6. The method according to claim 5, wherein the entity is identified in an access control list.

7. The method according to claim 1, wherein the messages are transmitted after connection to the entity.

8. A monitoring system adapted to implement the method according to claim 1, wherein the system comprises:

at least one tracking device, at least one piece of equipment detecting the presence and/or the availability of the entity;

means for establishing, inside the site between the tracking device and the detecting equipment, a data link conveying messages;

means to generate the secret candidate;

a piece of assessing equipment adapted to compare the secret and the secret candidate.

9. The monitoring system according to claim 8, comprising detection or constraint means of the position of the tracking device in the site.

10. The monitoring system according to claim 8, wherein the tracking device is a transmitting tracking device adapted to transmit messages, the equipment detecting the presence and/or availability of entity being adapted to receive and store messages.

11. The monitoring system according to claim 8, wherein the tracking device is a receiving tracking device adapted for receiving and storing messages, the equipment detecting the presence and/or availability of an entity being adapted to transmit messages.

12. The monitoring system according to claim 8, wherein the means for establishing a data link inside the site between the tracking device and the detector equipment comply with IEEE specification 802.15.4.

13. The method according to claim 1, comprising producing the proof of the presence and/or of the availability of the entity in a site over a period that is greater than or equal to the presence threshold only if the secret and the secret candidate are equal.

14. The method according to claim 1, wherein, prior to said transmitting, the method comprises generating a sequence of said messages from said secret.

15. The method according to claim 14, wherein said secret is reconstituted using a number of messages greater than or equal to said threshold and equal to or lower than a total number of messages in said sequence.

16. The method according to claim 14, wherein said sequence is generated in a geographic area that is substantially similar to that where said entity proves its presence and/or availability.

17. The method according to claim 1, comprising generating a secret candidate from the messages received by the entity.

18. The method according to claim 17, wherein the secret candidate is generated using a Lagrange polynomial.

* * * * *